United States Patent [19]

Lanoue et al.

[11] 4,307,364

[45] Dec. 22, 1981

[54] ELECTRICAL REACTOR WITH FOIL WINDINGS

[75] Inventors: Thomas J. Lanoue, Muncie, Ind.; Alan H. Cookson, Pittsburgh; Thomas W. Dakin, Murrysville, both of Pa.

[73] Assignee: Westinghouse Electric Corp., Pittsburgh, Pa.

[21] Appl. No.: 150,481

[22] Filed: May 16, 1980

[51] Int. Cl.[3] ..... H01F 27/08

[52] U.S. Cl. ..... 336/60; 336/180; 336/223; 336/231

[58] Field of Search ..... 336/60, 180, 206, 223, 336/232, 225, 231

[56] References Cited

U.S. PATENT DOCUMENTS

| | | | |
|---|---|---|---|
| 3,163,839 | 12/1964 | Zark | 336/206 X |
| 3,504,321 | 3/1970 | Benke | 336/184 |
| 3,602,857 | 8/1971 | Robin | 336/60 |
| 3,621,427 | 11/1971 | Bennon | 336/180 X |
| 3,663,910 | 5/1972 | Grubb | 336/60 X |
| 3,761,852 | 9/1973 | Albrecht | 336/60 X |
| 3,902,147 | 8/1975 | Trench | 336/180 |
| 3,993,183 | 7/1961 | Moore et al. | 336/60 |

FOREIGN PATENT DOCUMENTS

| | | | |
|---|---|---|---|
| 719336 | 10/1965 | Canada | 336/232 |
| 1557337 | 2/1969 | France | 336/223 |

OTHER PUBLICATIONS

"A New Concept for Compressed Gas-Insulated Transformer," 7th IEEE/PES Transmission and Distribution Conference and Exposition, Apr. 1-6, 1979, 79CH1399-J-5WR, pp. 178-183.

*Primary Examiner*—Thomas J. Kozma
*Attorney, Agent, or Firm*—E. L. Pencoske

[57] ABSTRACT

An iron core shunt reactor is constructed of a plurality of foil windings coaxially positioned along an iron core a discrete distance from each other. A coolant circulates axially along the core and radially outward between each of the foil windings providing the shunt reactor with improved thermal characteristics.

7 Claims, 5 Drawing Figures

ELECTRICAL REACTOR WITH FOIL WINDINGS

BACKGROUND OF THE INVENTION

1. Field of the Invention

This invention relates generally to electrical reactors and more specifically to iron core shunt reactors utilizing a liquid or gas coolant.

2. Description of the Prior Art

Power may be regarded as consisting of two components, real power measured in watts and reactive power measured in VAR's. The term VAR is derived from "volt-amperes reactive". For a transmission line the VAR requirements increase with the square of the voltage. The VAR requirements also increase with increased line capacitance and longer transmission lines. The use of long high voltage (HV) and extra high voltage (EHV) transmission lines, with high voltage defined as 100 kV to 229 kV, and extra high voltage defined as all voltages over 230 kV, has resulted in attendant increases in the VAR requirements on the systems connected to the end of the transmission lines. Further, the increased capacitance of bundled conductors commonly used for EHV transmission lines has greatly increased the VAR requirements compared with the conductors normally used with high voltage transmission lines.

The VAR requirements are important because if the system located at the end of the transmission line is unable to absorb the VAR's produced, the terminal voltages may rise to magnitudes capable of damaging apparatus connected thereto. Accordingly, it has become common to provide compensation for long HV and EHV transmission lines which may have periods of light loads, or transmission lines which are lightly loaded in the early stages of development of the system they are servicing. This compensation is provided by connecting shunt reactors to the HV or EHV line at the receiving end of the system. Shunt reactors may also be connected to the line at one or more selected intermediate points depending upon the length and the voltage profile desired across the transmission line.

There are two main types of shunt reactors, reactors having an air core and reactors having an iron core. An example of an air core reactor is U.S. Pat. No. 3,902,147. Disclosed therein is an air core duplex reactor consisting of two or more sets of rigid cylindrical coil assemblies disposed in concentric, radially spaced relation. Another example of an air core reactor is U.S. Pat. No. 3,621,427, which is assigned to the same assignee as the present invention. The reactor disclosed therein utilizes series connected pancake windings immersed in a liquid insulating and cooling dielectric such as mineral oil. This allows the reactor to be operated at higher voltages. It is noteworthy to point out that technically the reactor does not have on air core since the air has been displaced by the liquid coolant. However, since the reactor does not have a core capable of shaping the field of magnetic flux, the reactor is considered by the industry to be an air core reactor.

An example of an iron core reactor is U.S. Pat. No. 3,504,321 which is assigned to the same assignee as the present invention. Disclosed therein is a duplex reactor utilizing two long coils constructed of several turns of a sheet or foil conductor. Iron core reactors have also been used in conjunction with liquid insulating and cooling dielectrics thus allowing them to operate at higher voltages.

SUMMARY OF THE INVENTION

The present invention is an improved iron core shunt reactor. The core is constructed of small pieces of coated electrical steel which are pressed in a mold to the density required to achieve a specific low permeability. The low permeability results in a high reluctance magnetic circuit thereby reducing the number of air gaps and the amount of leakage flux. A plurality of foil windings are coaxially positioned along the iron core a discrete distance from each other. The core and foil windings are contained within a metal casing which is pressurized with sulfur hexafluoride ($SF_6$). The positioning of the foil windings allows the $SF_6$ gas to circulate axially along the core and radially outward between the foil windings, thus providing the present invention with improved thermal characteristics.

Each foil winding is constructed of a narrow strip of a conductive foil. A layer of insulation is disposed on the conductive foil. The conductive foil is then wound about a mandrel to form a foil winding. Because of the winding's geometry there is a very high turn to turn capacitance and a very low winding to ground capacitance. This geometry provides improved impulse distribution characteristics and requires less turn to turn insulation than conventional designs. Since less insulation is required the average turn length is decreased thereby decreasing the size, weight, and losses of the shunt reactor.

The noise generated by a shunt reactor is caused by coil movement with respect to adjacent coils. Coil movement is due to attractive forces which are developed by the coils when carrying a current. The present invention reduces the current carried by each coil, and thus reduces the attractive forces, by connecting all of the foil windings in parallel. Since the forces between the foil windings vary as the current squared, coil movement and generated sound will be minimized.

Another advantage of using foil windings is that the foil windings may be prefabricated and stacked into a final assembly.

Finally, the use of $SF_6$ instead of a liquid dielectric, such as oil, will provide the instant invention with advantages over the prior art. Specifically, the present reactor will be compatible with compressed gas insulated substations. Lower clearances between the windings and ground and the windings and the core are obtainable, thus resulting in a further reduction of size. Compressed gas does not transmit sound as well as oil, thereby resulting in a further reduction of noise. These and other advantages are discussed hereinafter.

DESCRIPTION OF THE PREFERRED EMBODIMENT

Figure 1:
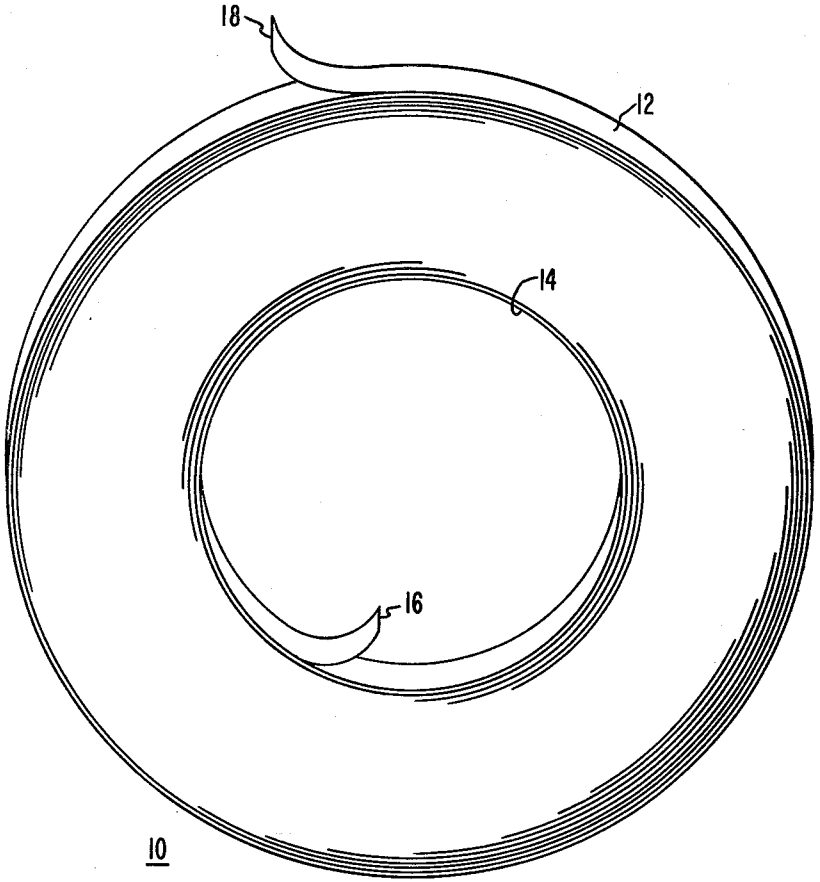
FIG. 1 illustrates a foil winding constructed in accordance with the present invention.

Referring to FIG. 1 a foil winding 10 constructed in accordance with the present invention is illustrated. The foil winding 10 is constructed of a plurality of concentric turns of a narrow strip of an insulated conductive foil 12. The conductive foil 12 may be a commercially available foil of aluminum or copper. The conductive foil 12 is provided with a thin layer of insulating material and is wound about a mandrel or the like producing the foil winding 10. The foil winding is wound such that it has a central opening 14 at its center. The foil winding 10 has a first, or beginning, end 16 at a small radius from its center and a second, or terminating, end 18 at a larger radius from its center. A conductive path of high capacitance is provided between the first 16 and the second 18 ends of the foil winding 10.

Figure 2:
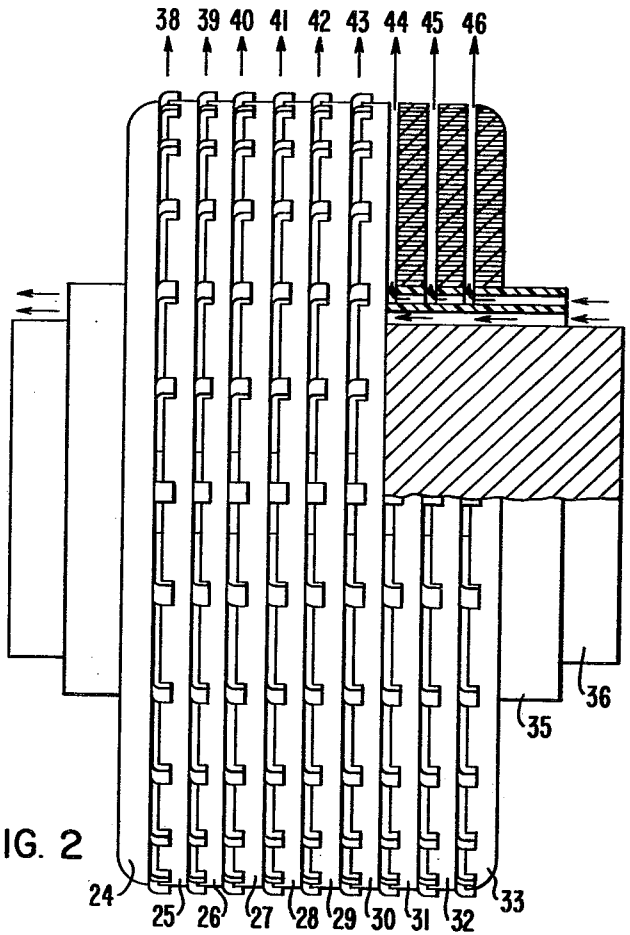
FIG. 2 is a side view of foil windings for a reactor constructed and arranged in accordance with the present invention.

FIG. 2 illustrates a group of ten foil windings 24 through 33, inclusive, constructed and arranged in accordance with the present invention for use in an iron core shunt reactor. The eight foil windings 25 through 32 are each constructed in accordance with the description of FIG. 1 and are thus identical to each other. The end foil windings 24 and 33 are also constructed in accordance with the description of FIG. 1 except that as the radius of the foil winding increases the width of the conductive foil decreases. This results in a rounding of the outer edges of the foil windings 24 and 33. The rounding of the outer edges of the windings 24 and 33 is necessary to prevent electrical breakdown and corona effects.

A winding tube or drum 35 extends through the central openings of the ten foil windings 24 through 33. The winding drum 35 is cylindrical in shape and has an outside diameter complementary to the central openings of the foil windings 24 through 33 such that the foil windings are firmly fitted on the winding drum 35. The winding drum 35 has an opening extending therethrough for receiving and firmly engaging a magnetic iron core 36. The foil windings 24 through 33 are thus coaxially positioned along the magnetic core 36. The magnetic core 36 is constructed of very small pieces of coated steel which are pressed together in a mold to the density required. This achieves a specific low permeability which results in a high reluctance magnetic field, thereby reducing the number of air gaps and the amount of leakage flux. In a preferred embodiment, the magnetic core 36 is constructed of microlaminations, such as disclosed in U.S. Pat. No. 4,158,582, which is assigned to the same assignee of the present application.

Each of the ten foil windings is displaced a discrete distance from its neighboring windings. This spacing allows a coolant to circulate radially outward between the foil windings as illustrated by the arrows 38 through 46, inclusive. The circulation of the coolant is described in more detail in conjunction with FIG. 3.

There are several advantages associated with the construction and arrangement of the foil windings 24 through 33 illustrated in FIG. 2. First, this construction and arrangement allows a maximum surface area of each foil winding to be exposed. Second, the heat transfer along the foil to its edges is more efficient than the transfer of heat in the radial direction across the foil turns and intermediate insulation. Third, the radial coolant paths illustrated by the arrows 38 through 46 represent a minimum distance the coolant must travel in order to contact the entire exposed area of each foil winding. The combination of maximum exposed area with minimum coolant path length provides the present invention with excellent thermal characteristics. Fourth, any point on any of the windings 25 through 32 is at the same voltage potential as an adjacent point on its neighboring windings. Thus, there is a very low leakage capacitance to ground. Additionally, the foil configuration itself provides for high series, or turn to turn, capacitance and a uniform voltage distribution across the windings. The uniform voltage distribution results in good impulse distribution across the windings. These factors, low leakage capacitance, high series capacitance, and uniform voltage distribution, allow the insulation between the turns of the windings to be minimal. This results in an improved space utilization factor, i.e. smaller turn length and more turns per unit volume. This results in a considerable savings in size and weight of the shunt reactor. Finally, the foil windings may be prefabricated and an appropriate number stacked in a final assembly to provide a shunt reactor with the required rating.

Figure 3:
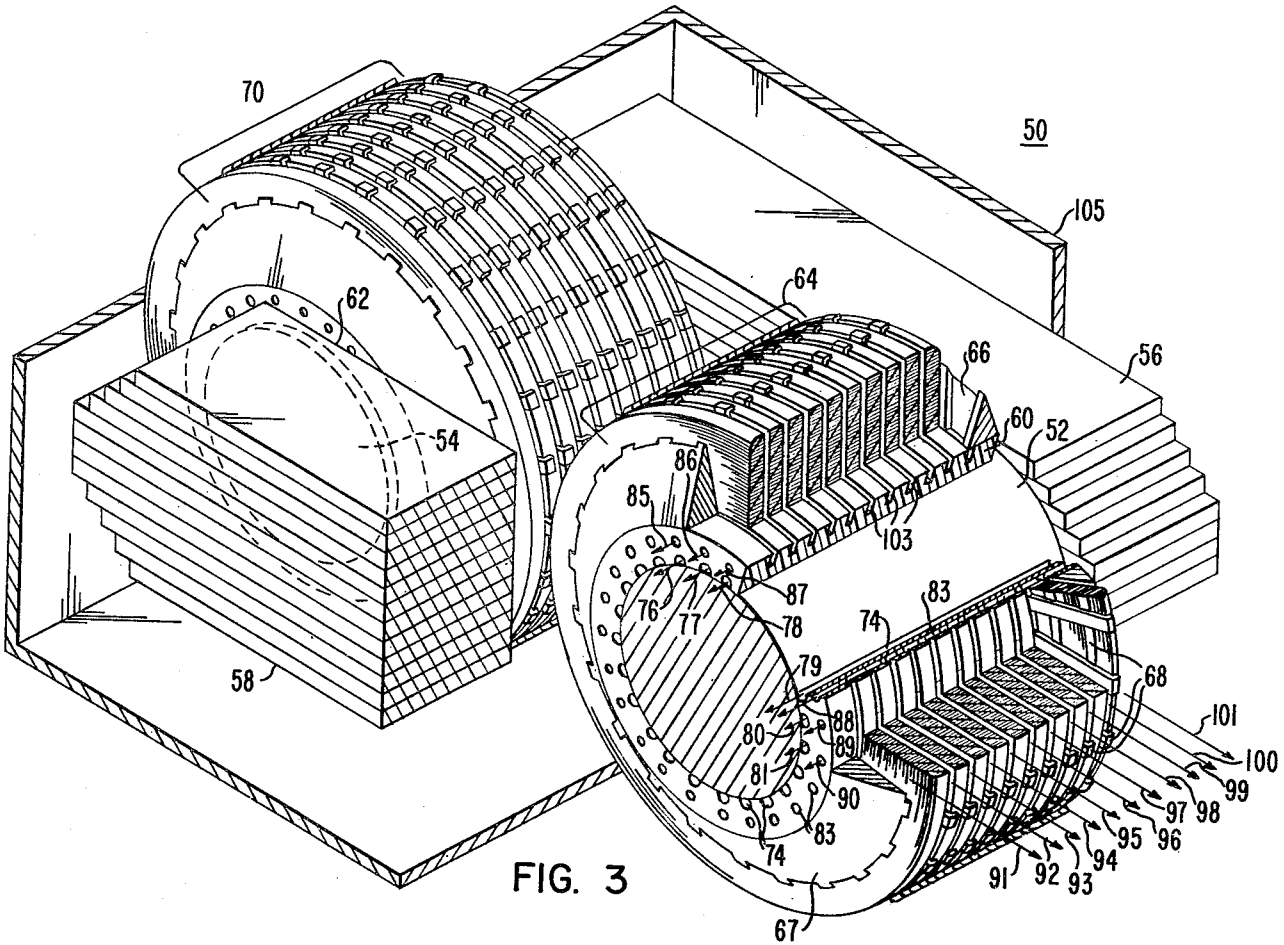
FIG. 3 is a perspective view shown partially cut away and partially in section, of a shunt reactor core and winding arrangement constructed in accordance with the present invention.

Turning now to FIG. 3 a perspective view of a duplex shunt reactor 50 is illustrated. A first core segment, or leg portion, 52 and a second core segment, or leg portion, 54 are connected by yokes 56 and 58. The yoke 58 is not shown entirely so that internal details may be shown. The first core segment 52 is constructed of microlaminations and is enclosed in a first winding drum 60. The first winding drum 60 supports a first set of windings 64. The first set of windings 64 is composed of ten separate foil windings each separated by a radial support 68. The first set of windings 64 is further supported by end supports 66 and 67. The end supports 66 and 67 together with the radial supports 68 prevent the foil windings from moving and maintain a discrete distance between the windings.

The first winding drum 60 has a plurality of core cooling ducts 74. The core cooling ducts 74 are parallel to, and in contact with, the first core segment 52. The core cooling ducts 74 allow coolant to flow axially along the first core segment 52 as shown by arrows 76 through 81 inclusive. In this manner the first core segment 52 is cooled. The first winding drum has a plurality of winding cooling ducts 83 parallel to the first core segment 52. The winding cooling ducts 83 are intersected by a plurality of circumferential grooves 103 located around the outside of the first winding drum 60. The circumferential grooves 103 coincide with the discrete spaces between the individual foil windings. The coolant thus flows axially through the winding cooling ducts 83 as indicated by the arrows 85 through 90, inclusive, and radially outward between each of the foil windings as shown by the arrows 91 through 101, inclusive.

Figure 4:
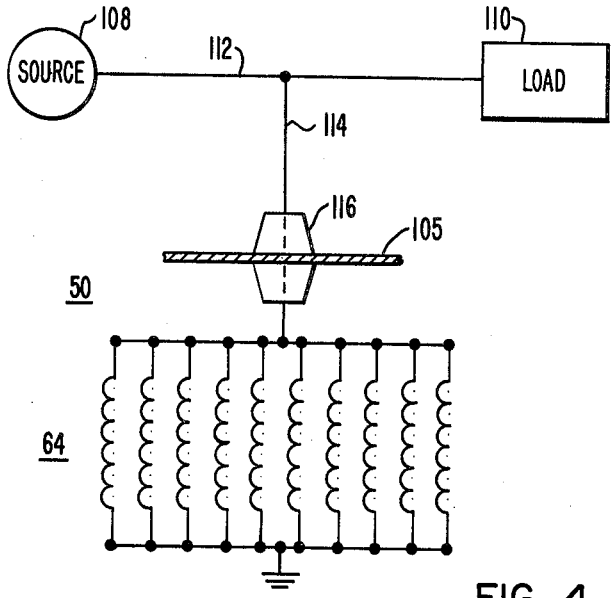
FIG. 4 is a schematic illustrating the parallel connection of the foil windings of a shunt reactor connected to an electrical distribution system.

Each of the ten foil windings which make up the first set of foil windings 64 is connected at its first end to a neutral conductor, not shown, and is connected at its second end to a high voltage conductor, not shown. In this manner, the ten foil windings comprising the first set of foil windings 64 are connected in parallel. The parallel connection of the foil windings is shown schematically in FIG. 4. In FIG. 4 a power source 108 is connected to a load 110 by a long high voltage transmission line 112. A conductor 114 connects the shunt reactor 50 to the transmission line 112 at a point chosen to provide the desired voltage profile for the transmission line 112. The conductor 114 connects the transmission line 112 to the parallel connected foil windings 64 through a bushing 116 in the metal case 105. By connecting the foil windings in parallel the current carried by each winding is minimized. Since the current carried by each winding is minimized the attractive forces between windings is minimized, thus reducing the amount of noise produced by movement of the foil windings.

The second core segment 54 shown in FIG. 3 is constructed of microlaminations and is enclosed in a second winding drum 62. The second winding drum 62 supports a second set of foil windings 70. The second set of foil windings 70 is composed of ten separate foil windings connected in parallel. The second winding drum 62 and the second set of windings 70 are identical in construction and operation to the first winding drum 60 and the first set of windings 64, respectively.

For purposes of illustration and not limitation a 167 MVAR electrical shunt reactor is constructed of two sets of foil windings. Each set contains ten individual foil windings having a 0.375 inch (9.5 mm) separation therebetween. Each foil winding is constructed of a conductive foil having a width of 3 inches (76.2 mm) and a thickness of $5.5\times10^{-3}$ inches (0.14 mm). The foil is provided with a $1\times10^{-3}$ inch (0.025 mm) layer of insulation on each side. The insulated foil is then wound about a mandrel or the like such that the completed foil winding has an outside diameter of 84.5 inches (2146.3 mm) and an inside diameter of 48.5 inches (76.2 mm).

The duplex shunt reactor 50 shown in FIG. 3 is enclosed in a metal case 105 and pressurized with a coolant such as sulphur hexafluoride ($SF_6$). The use of sulphur hexafluoride has many advantages over other coolant materials. Lower clearances between the windings and ground and the windings and the core are achieved resulting in a reduction of size of the shunt reactor. A shunt reactor using $SF_6$ is compatible with compressed gas insulated substations. Additionally, $SF_6$ is compressible, flame retardant, non-explosive, and light weight. $SF_6$ is also non-aging, non-toxic, and has a fast recovery time after a failure with a minimum of by-products. Further, since $SF_6$ will not transmit sound as easily as a liquid, the present reactor has improved noise characteristics.

Figure 5:
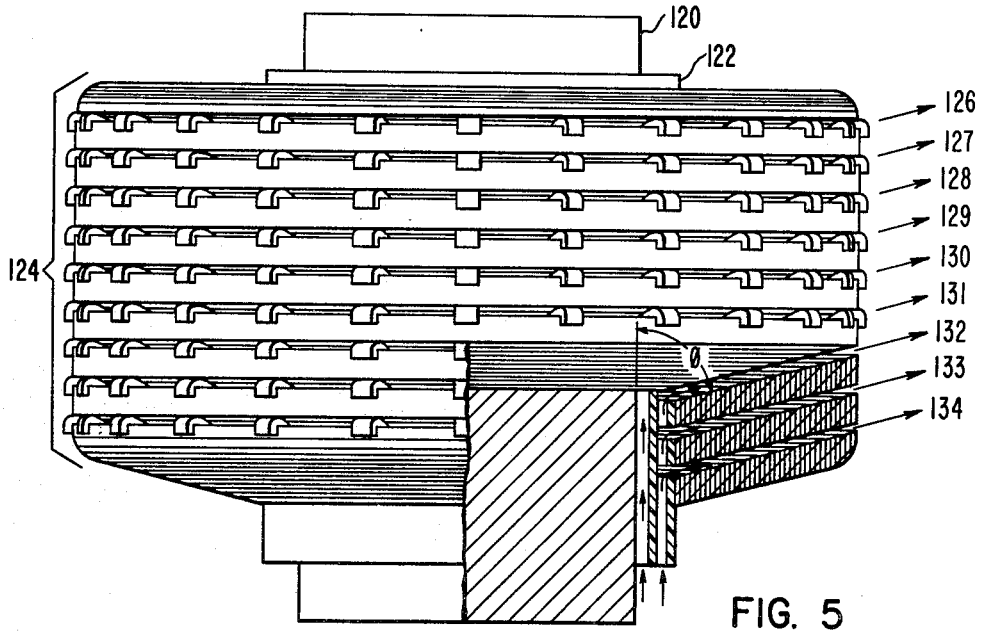
FIG. 5 is a side view of dished foil windings having improved coolant circulation characteristics.

It may be advantageous in some embodiments of the present invention to include a system for circulating the $SF_6$ coolant for forced cooling of the reactor. Additional benefits may be achieved by dishing the foil windings to improve circulation of the $SF_6$ coolant as illustrated in the vertical configuration of FIG. 5. In FIG. 5 a magnetic core 120 is enclosed in a winding drum 122. The winding drum 122 carries a set of ten foil windings 124. The core 120 and winding drum 122 are oriented vertically such that the foil windings 124 are positioned in a stack-like configuration. Each foil winding is dished upward such that each foil winding forms an angle $\phi$ with the winding drum 122, where $\phi$ is less than ninety degrees. In this manner coolant flow between each of the ten foil windings, illustrated by the arrows 126 through 124, inclusive, is improved.

Briefly reviewing, an iron core shunt reactor is disclosed which is constructed of a plurality of foil windings. The foil windings are coaxially positioned along an iron core a discrete distance from each other. This allows a coolant to circulate axially along the iron core and radially outward between each of the foil windings. The geometry of the foil windings and positioning of the windings along the core provide for a reactor having improved thermal and noise characteristics.

What is claimed is:

1. An electrical reactor having improved thermal and dielectric characteristics due to both axial and radial coolant paths, comprising:

a casing;

an insulating gas in said casing;

a magnetic core in said casing, said magnetic core having at least one winding leg;

winding support means disposed about said winding leg, said winding support means defining a plurality of circumferential grooves, further defining a plurality of first cooling ducts disposed parallel to the longitudinal direction of said winding leg which direct said insulating gas axially through said winding support means, and further defining in cooperation with said winding leg, a plurality of second cooling ducts disposed parallel to the longitudinal direction of said winding leg which direct said insulating gas axially through said winding support means and along said winding leg;

a plurality of spacer members;

a plurality of foil windings coaxially spaced along said winding support means, with said spacer members being disposed between adjacent foil windings to maintain the spacing therebetween, said spaced foil windings defining a plurality of third cooling ducts which extend radially outward from said winding support means, said first and third cooling ducts and said circumferential grooves being in fluid flow communication to cooperatively define a plurality of fluid flow paths each of which includes an axial flow path through said winding support means and a radial flow path between adjacent windings; and means electrically connecting said foil windings in parallel.

2. The reactor of claim 1 wherein the magnetic core includes a core constructed of microlaminations.

3. The reactor of claim 1 wherein the insulating gas includes sulphur hexafluoride.

4. The reactor of claim 1 wherein the foil winding includes a narrow strip of an aluminum foil wound in a plurality of concentric turns, each turn separated by a thin layer of insulation such that an electrical path of high series capacitance is provided.

5. The reactor of claim 1 wherein the conductive foil winding includes a narrow strip of a copper foil wound in a plurality of concentric turns, each turn separated by a thin layer of insulation such that an electrical path of high series capacitance is provided.

6. The reactor of claim 1 wherein a first foil winding and a last foil winding of the plurality of foil windings are constructed of a conductive foil having a progressively smaller width as the radius from the core increases.

7. The reactor of claim 1 wherein the foil windings are positioned vertically and dished upward thereby improving gas flow.

* * * * *